US011946673B2

(12) United States Patent
Zhang et al.

(10) Patent No.: US 11,946,673 B2
(45) Date of Patent: Apr. 2, 2024

(54) HEAT EXCHANGE SYSTEM AND METHOD FOR RECLAIMING CORROSION INHIBITOR IN HEAT EXCHANGE SYSTEM

(71) Applicant: CARRIER CORPORATION, Palm Beach Gardens, FL (US)

(72) Inventors: Xiangyuan Zhang, Shanghai (CN); Haiping Ding, Shanghai (CN); Haitao Zhang, Shanghai (CN); Michael A. Stark, Mooresville, NC (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 106 days.

(21) Appl. No.: 17/252,927

(22) PCT Filed: May 13, 2020

(86) PCT No.: PCT/US2020/032598
§ 371 (c)(1),
(2) Date: Dec. 16, 2020

(87) PCT Pub. No.: WO2020/236472
PCT Pub. Date: Nov. 26, 2020

(65) Prior Publication Data

US 2022/0065502 A1 Mar. 3, 2022

(30) Foreign Application Priority Data

May 17, 2019 (CN) ..... 201910411632.X

(51) Int. Cl.
*F25B 31/00* (2006.01)
*F25B 41/00* (2021.01)
*F25B 43/02* (2006.01)

(52) U.S. Cl.
CPC ..... *F25B 31/004* (2013.01); *F25B 41/00* (2013.01); *F25B 43/02* (2013.01); (Continued)

(58) Field of Classification Search
CPC ..... F25B 31/004; F25B 41/00; F25B 43/02; F25B 2341/0014; F25B 2341/0016; (Continued)

(56) References Cited

U.S. PATENT DOCUMENTS 2,841,962 A 7/1958 Richards
4,558,573 A 12/1985 La Monica
(Continued)

FOREIGN PATENT DOCUMENTS

CN 101017035 A * 8/2007
DE 133063 A1 11/1978
EP 1119732 8/2001

OTHER PUBLICATIONS

Pdf is translation of foreign reference CN-101017035-A (Year: 2007).*

(Continued)

*Primary Examiner* — Len Tran
*Assistant Examiner* — Kamran Tavakoldavani
(74) *Attorney, Agent, or Firm* — CANTOR COLBURN LLP

(57) ABSTRACT

A heat exchange system and a method for reclaiming corrosion inhibitor in a heat exchange system are provided by the present disclosure. The heat exchange system includes a compressor (1), a condenser (2) and an evaporator (3) connected in sequence, and the heat exchange system further includes a system for reclaiming corrosion inhibitor which includes an ejector (6) including a high-pressure fluid inlet (61) connected to an outlet (11) of the compressor, a suction fluid inlet (62) connected to the heat exchange system to extract a liquid-state refrigerant in the heat exchange system, and a fluid outlet (63) leading to bearings of the compressor, wherein a pressurizing device (5) is provided between the outlet of the compressor and the high-pressure fluid inlet of the ejector. The heat exchange system according to the embodiments of the present disclosure can provide sufficient corrosion inhibitor to the bearings of the compressor under various working conditions.

9 Claims, 1 Drawing Sheet

(52) U.S. Cl.
CPC ..... *F25B 2341/0014* (2013.01); *F25B 2341/0016* (2013.01); *F25B 2500/16* (2013.01)

(58) Field of Classification Search
CPC .... F25B 2500/16; F25B 31/002; F25B 47/00; F25B 47/003; F25B 2347/00
See application file for complete search history.

(56) References Cited

U.S. PATENT DOCUMENTS

| | | | | |
|---|---|---|---|---|
| 4,938,664 | A | 7/1990 | Zinsmeyer | |
| 9,134,056 | B2 * | 9/2015 | Levy | F25B 25/02 |
| 2012/0324911 | A1 * | 12/2012 | Shedd | F25B 41/00 62/62 |
| 2014/0260404 | A1 * | 9/2014 | Verma | F25B 25/005 62/333 |
| 2017/0254573 | A1 * | 9/2017 | Numata | F25B 39/028 |

OTHER PUBLICATIONS

Pdf is original document of foreign reference CN-101017035-A (Year: 2007).*
International Search Report issued in Application No. PCT/US2020/032598 dated Aug. 3, 2020, 7 pages.
Written Opinion issued in Application No. PCT/US2020/032598 dated Aug. 3, 2020, 9 pages.

* cited by examiner

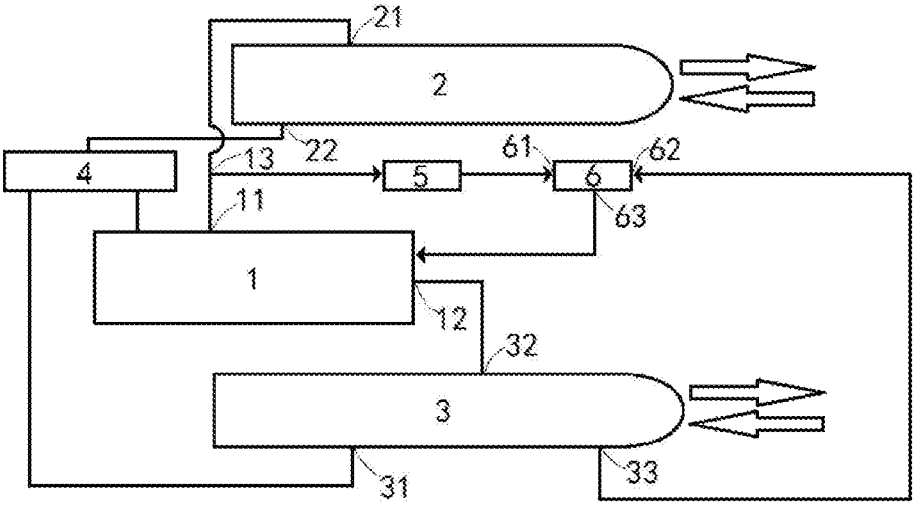
21
2
22
13
4
5
61
6
62
11
63
1
12
32
3
31
33

HEAT EXCHANGE SYSTEM AND METHOD FOR RECLAIMING CORROSION INHIBITOR IN HEAT EXCHANGE SYSTEM

FIELD OF THE INVENTION

The present disclosure relates to a heat exchange system, and more particularly to a device and a method for reclaiming corrosion inhibitor in a heat exchange system.

BACKGROUND OF THE INVENTION

In heat exchange systems, such as refrigeration systems, since a bearing chamber of compressor is unsealed, the corrosion inhibitor such as oil therein will gradually flow out and mix with refrigerant, enter a refrigeration cycle with the refrigerant, and may accumulate in a liquid-phase refrigerant, such as in an evaporator. Therefore, a system for reclaiming corrosion inhibitor is required in the heat exchange system to return the corrosion inhibitor back to the bearing chamber of the compressor. A pump may be used in existing systems to extract a liquid-state refrigerant mixed with corrosion inhibitor, but cavitation will occur when the pump is exposed to the refrigerant in a gas-liquid phase.

SUMMARY OF THE INVENTION

The object of the present disclosure is to solve or at least alleviate the problems existing in the related art.

In one aspect, a heat exchange system is provided, which includes: a compressor, a condenser and an evaporator connected in sequence, wherein the heat exchange system further includes a system for reclaiming corrosion inhibitor, the system for reclaiming corrosion inhibitor including:

an ejector including a high-pressure fluid inlet connected to an outlet of the compressor, a suction fluid inlet connected to the heat exchange system to extract a liquid-state refrigerant in the heat exchange system, and a fluid outlet leading to bearings of the compressor, wherein a pressurizing device is provided between the outlet of the compressor and the high-pressure fluid inlet of the ejector.

Optionally, in an embodiment of the heat exchange system, the pressurizing device is a pump or an additional compressor.

Optionally, in an embodiment of the heat exchange system, the suction fluid inlet is connected to a bottom of the evaporator to extract a liquid-state refrigerant with corrosion inhibitor.

Optionally, in an embodiment of the heat exchange system, the heat exchange system further includes an economizer connected between the condenser and the evaporator, and the suction fluid inlet is connected to a bottom of the economizer to extract a liquid-state refrigerant with corrosion inhibitor.

Optionally, in an embodiment of the heat exchange system, the compressor is a centrifugal compressor, and the corrosion inhibitor is oil.

In another aspect, a method for reclaiming corrosion inhibitor in a heat exchange system is provided, the heat exchange system including a compressor, a condenser and an evaporator connected in sequence, and the method including:

providing an ejector in the heat exchange system, connecting a high-pressure fluid inlet of the ejector to an outlet of the compressor, connecting a suction fluid inlet of the ejector to the heat exchange system to extract a liquid-state refrigerant in the heat exchange system, and leading a fluid outlet of the ejector to bearings of the compressor, wherein the method further includes: providing a pressurizing device between the outlet of the compressor and the high-pressure fluid inlet of the ejector.

Optionally, the pressurizing device is a pump or an additional compressor.

Optionally, the method includes connecting the suction fluid inlet to a bottom of the evaporator to extract a liquid-state refrigerant with corrosion inhibitor.

Optionally, the method includes connecting the suction fluid inlet to a bottom of an economizer between the condenser and the evaporator to extract a liquid-state refrigerant with corrosion inhibitor.

Optionally, the compressor is a centrifugal compressor, and the corrosion inhibitor is oil.

The heat exchange system according to the embodiments of the present disclosure can provide sufficient corrosion inhibitor to the bearings of the compressor under various working conditions.

BRIEF DESCRIPTION OF THE DRAWINGS

The contents of the present disclosure will become easier to understand with reference to the accompanying drawings. It can be easily understood by those skilled in the art that the drawings are merely used for illustration, and are not intended to limit the scope of protection of the present disclosure. In addition, like parts are denoted by like numerals in the drawings, wherein:

FIG. 1 shows a schematic structural view of a heat exchange system according to an embodiment of the present disclosure.

DETAILED DESCRIPTION OF THE EMBODIMENT(S) OF THE INVENTION

It will be readily understood that, based on the technical solutions of the present disclosure, those skilled in the art can propose various alternative structural forms and implementations without departing from the true spirit of the present disclosure. Therefore, the following specific embodiments and the accompanying drawings are merely exemplary description of the technical solutions of the present disclosure, which shall not be deemed as the entirety of the present disclosure or as limiting or restricting the technical solutions of the present disclosure.

Such orientational terms as "upper", "lower", "left", "right", "front", "rear", "front side", "back side", "top", "bottom" or the like that are mentioned or may be mentioned in this description are defined with respect to the configurations shown in the individual drawings. They are relative concepts and thus possibly vary according to their different locations or different states of use. Therefore, these or other orientational terms shall not be interpreted as limiting terms.

A heat exchange system according to an embodiment of the present disclosure will be described in detail with reference to FIG. 1. The heat exchange system according to the embodiment of the present disclosure may include a compressor 1, a condenser 2 and an evaporator 3 connected in sequence, and an optional economizer 4 between the condenser 2 and the evaporator 3. More specifically, the compressor 1 includes an outlet 11 of the compressor and an inlet 12 of the compressor, the outlet 11 of the compressor is connected to an inlet 21 of the condenser 2 through a pipeline, and an outlet 22 of the condenser 2 is connected to the economizer 4 through a pipeline, and then connected to an inlet 31 of the evaporator; and an outlet 32 of the evaporator is connected to the inlet 12 of the compressor through a pipeline. The condenser 2 and the evaporator 3 exchange heat with the environment or a coolant respectively, in order to adjust the temperature. It should be understood that the heat exchange system shown in the figure is only exemplary, and more components and devices such as pipelines may be included in practical applications.

The heat exchange system also includes a system for reclaiming corrosion inhibitor which includes an ejector 6 including a high-pressure fluid inlet 61 connected to the outlet 11 of the compressor 1, a suction fluid inlet 62 connected to the heat exchange system to extract a liquid-state refrigerant in the heat exchange system, and a fluid outlet 63 leading to bearings of the compressor 1. In the system for reclaiming corrosion inhibitor, a pressurizing device 5 is provided between the outlet 11 of the compressor and the high-pressure fluid inlet 61 of the ejector 6. In the embodiment shown in the figure, the outlet 11 of the compressor is connected to the pressurizing device 5, and the pressurizing device 5 is connected to the high-pressure fluid inlet 61 of the ejector 6. Specifically, the pressurizing device 5 is connected to a certain position 13 on a pipeline between the outlet 11 of the compressor and the inlet 21 of the condenser 2. The suction fluid inlet 62 of the ejector 6 may be connected to any suitable position in the heat exchange system to extract a liquid-state refrigerant. As a non-limiting example, the suction fluid inlet 62 of the ejector 6 is connected to a bottom of the evaporator 3 to extract a liquid-state refrigerant mixed with corrosion inhibitor in the evaporator. It should be understood that during the use of the heat exchange system, the corrosion inhibitor in a bearing chamber of the compressor will be gradually mixed into the refrigerant to participate in the refrigeration cycle. Most of the corrosion inhibitor will accumulate in the liquid-state refrigerant such as in the evaporator. Therefore, the ejector 6 can draw the corrosion inhibitor back to the bearing chamber of compressor. The fluid outlet 63 of the ejector 6 leads to the bearings of the compressor 1 through a pipeline, such as to a bearing chamber, i.e., the outlet of the pipeline may, for example, be aligned with the bearing chamber of the compressor 1 so that the corrosion inhibitor can be applied to the bearings. A filter may be arranged on a pipeline connecting the fluid outlet 63 of the ejector 6 and the bearing chamber of the compressor to prevent foreign matters from entering the bearing chamber of the compressor. In addition, it should be noted that the pipelines of the system for reclaiming corrosion inhibitor may be copper pipes.

During operation, a part of the high-pressure fluid discharged from the compressor 1 enters the high-pressure fluid inlet 61 of the ejector 6 through the pressurizing device 5 to produce a pressure difference between the ejector 6 and the evaporator 3, so that a liquid-state refrigerant mixed with corrosion inhibitor is extracted from the evaporator 3. The high-pressure fluid from the compressor 1 and the liquid-state refrigerant from the evaporator 3 are mixed in the ejector 6 and led to the bearings of the compressor 1 through the fluid outlet 63 of the ejector 6 to reclaim part of the corrosion inhibitor to the bearings of the compressor. The above-mentioned corrosion inhibitor reclaim circuit keeps running during the working process of the thermal cycle system so as to keep sufficient corrosion inhibitor at the bearings of the compressor 1 and avoid corrosion of the compressor bearings and compressor failures caused thereby. In the embodiment of the present disclosure, a combination of the ejector and the pressurizing device is used to reclaim the corrosion inhibitor to the bearing chamber of the compressor. By contrast, in a traditional solution of directly using a pump to extract a refrigerant mixed with corrosion inhibitor, the pump is prone to cavitation since the extracted refrigerant is in a gas-liquid mixed state. In addition, the pressurizing device 5 ensures that the high-pressure fluid inlet 61 of the ejector 6 is always under high pressure, so that a continuous corrosion inhibitor can be passed to the bearing chamber of the compressor even when the pressure at the outlet 11 of the compressor 1 is low.

In some embodiments, the pressurizing device 5 may be a pump, such as a small pump. In some embodiments, the pressurizing device 5 may also be an additional compressor, which has a significantly lower power than the compressor 1. In an alternative embodiment, the pressurizing device 5 can be any existing suitable pressurizing device. In some embodiments, the suction fluid inlet 62 may also be connected to a bottom of the economizer 4 (if any) to extract a liquid-state refrigerant with corrosion inhibitor from the economizer 4. In some other embodiments, the suction fluid inlet 62 may also be connected to other components in the heat exchange system, as long as the liquid-state refrigerant mixed with the corrosion inhibitor is accumulated in the component. Preferably, the suction fluid inlet 62 is connected to the bottom of the evaporator, since the pressure there is relatively low. In some embodiments, the compressor 1 may be a centrifugal compressor and the corrosion inhibitor may be oil.

In another aspect, the present disclosure also provides a method for reclaiming corrosion inhibitor in a heat exchange system, the method including: providing an ejector in the heat exchange system, connecting a high-pressure fluid inlet of the ejector to an outlet of the compressor, connecting a suction fluid inlet of the ejector to the heat exchange system to extract a liquid-state refrigerant in the heat exchange system, and leading a fluid outlet of the ejector to bearings of the compressor, wherein the method further includes: providing a pressurizing device between the high-pressure fluid inlet of the ejector and the outlet of the compressor. In some embodiments, the pressurizing device may be a pump or an additional compressor. In some embodiments, the method may include connecting the suction fluid inlet to a bottom of the evaporator to extract a liquid-state refrigerant with corrosion inhibitor. In some embodiments, the method may include connecting the suction fluid inlet to a bottom of an economizer between the condenser and the evaporator to extract the liquid-state refrigerant with corrosion inhibitor. In some embodiments, the compressor may be a centrifugal compressor and the corrosion inhibitor may be oil.

The specific embodiments described above are merely for describing the principle of the present disclosure more clearly, and various components are clearly illustrated or depicted to make it easier to understand the principle of the present disclosure. Those skilled in the art can readily make various modifications or changes to the present disclosure without departing from the scope of the present disclosure. Therefore, it should be understood that these modifications or changes should be included within the scope of protection of the present disclosure.

What is claimed is:

1. A system for reclaiming corrosion inhibitor in a heat exchange system including a compressor, a condenser and an evaporator connected in sequence, wherein the system for reclaiming corrosion inhibitor comprises:

an ejector comprising a high-pressure fluid inlet connected to an outlet of the compressor, a suction fluid inlet connected to the heat exchange system to extract a liquid-state refrigerant in the heat exchange system, and a fluid outlet leading to bearings of the compressor, wherein a pressurizing device is provided between the outlet of the compressor and the high-pressure fluid inlet of the ejector;

wherein the pressurizing device is an additional compressor.

2. The system for reclaiming corrosion inhibitor according to claim 1, wherein the suction fluid inlet is connected to a bottom of the evaporator to extract a liquid-state refrigerant with corrosion inhibitor.

3. The system for reclaiming corrosion inhibitor according to claim 1, wherein the heat exchange system further comprises an economizer connected between the condenser and the evaporator, and the suction fluid inlet is connected to a bottom of the economizer to extract a liquid-state refrigerant with corrosion inhibitor.

4. The system for reclaiming corrosion inhibitor according to claim 1, wherein the compressor is a centrifugal compressor, and the corrosion inhibitor is oil.

5. The system for reclaiming corrosion inhibitor according to claim 1, wherein the outlet of the compressor is connected to both the high-pressure fluid inlet of the ejector and the condenser.

6. A method for reclaiming corrosion inhibitor in a heat exchange system including a compressor, a condenser and an evaporator connected in sequence, and the method comprising:

providing an ejector, connecting a high-pressure fluid inlet of the ejector to an outlet of the compressor, connecting a suction fluid inlet of the ejector to the heat exchange system to extract a liquid-state refrigerant in the heat exchange system, and leading a fluid outlet of the ejector to bearings of the compressor, wherein the method further comprises: providing a pressurizing device between the outlet of the compressor and the high-pressure fluid inlet of the ejector;

wherein the pressurizing device is an additional compressor.

7. The method according to claim 6, wherein the method comprises connecting the suction fluid inlet to a bottom of the evaporator to extract a liquid-state refrigerant with corrosion inhibitor.

8. The method according to claim 6, wherein the method comprises connecting the suction fluid inlet to a bottom of an economizer between the condenser and the evaporator to extract a liquid-state refrigerant with corrosion inhibitor.

9. The method according to claim 6, wherein the compressor is a centrifugal compressor, and the corrosion inhibitor is oil.

* * * * *